US007416640B2

(12) United States Patent
Mark et al.

(10) Patent No.: US 7,416,640 B2
(45) Date of Patent: Aug. 26, 2008

(54) APPARATUS FOR FORMING AN EXTENDED NIP

(75) Inventors: Wolfgang Mark, Meerbusch (DE); Ralf Gross, Tönisvorst (DE); Axel Höhne, Moers (DE)

(73) Assignee: Andritz Kusters GmbH, Krefeld (DE)

( * ) Notice: Subject to any disclaimer, the term of this patent is extended or adjusted under 35 U.S.C. 154(b) by 499 days.

(21) Appl. No.: 11/147,579

(22) Filed: Jun. 7, 2005

(65) Prior Publication Data

US 2006/0086471 A1 Apr. 27, 2006

(30) Foreign Application Priority Data

Jun. 11, 2004 (DE) ..... 10 2004 028 480

(51) Int. Cl.
*D21F 3/06* (2006.01)
*B30B 3/02* (2006.01)

(52) U.S. Cl. ..... 162/358.3; 100/153; 100/156

(58) Field of Classification Search ..... 162/205–207, 162/358.1, 358.3, 358.4, 358.5; 100/37, 100/153, 156, 168
See application file for complete search history.

(56) References Cited

U.S. PATENT DOCUMENTS 3,921,514 A * 11/1975 Biondetti ..... 100/162 B
5,385,088 A * 1/1995 Grabscheid ..... 100/168
5,507,223 A * 4/1996 Vallius ..... 100/153
5,535,670 A * 7/1996 Schiel et al. ..... 100/153
5,547,547 A * 8/1996 Bengtsson ..... 162/272
5,693,186 A * 12/1997 Vallius ..... 162/199
5,865,112 A * 2/1999 Grabscheid et al. ..... 100/168
2004/0168585 A1 * 9/2004 Aho ..... 100/327

FOREIGN PATENT DOCUMENTS

DE 3242721 5/1984
WO WO 03/004889 * 1/2003
WO WO2004/035916 4/2004

* cited by examiner

*Primary Examiner*—Eric Hug
(74) *Attorney, Agent, or Firm*—Townsend and Townsend and Crew LLP

(57) ABSTRACT

Apparatus for forming an extended nip between a mating roll and a shoe roll for treating a product web, in particular a paper web, the roll axes of which lie in a loading plane E, having a mating roll which is supported via in each case one roll-end assembly on in each case one bearing in a first bracket, having a shoe roll which has stationary bearing journals which are supported in each case via a bearing in in each case one second bracket, one of the brackets being fastened to a stand, and having releasable devices for connecting the brackets to one another, the releasable connecting elements comprising connecting lugs which are guided displaceably in grooves of one of the brackets between a locked position and at least one unlocked position along connecting axes, each connecting lug having a slot which extends parallel to a connecting axis and through which fastening pins which can be inserted in the locked position into one and the other bracket can be inserted and can be brought into engagement with opposite force action faces of the respective slot.

21 Claims, 3 Drawing Sheets

APPARATUS FOR FORMING AN EXTENDED NIP

The invention relates to an apparatus for forming an extended nip between a mating roll and a shoe roll for treating a product web.

Apparatuses of this type having a shoe roll which has a press section are known for treating a product web, in particular for dewatering and/or calendering a paper web. The frame parts which accommodate the rolls are in contact with one another only in the unloaded state and with a relatively low contact force. For high contact forces, the connection of the frame parts has to be designed in such a way that it can absorb the forces which act in the nip direction as a tensile force.

DE 32 42 721 C2 has disclosed a wet press for dewatering a running fibrous web, in which the rolls are supported in two frame-like stands. One of the frames lies on a bottom plate. In contrast, the other frame is subdivided into an upper frame part and into a lower frame part, in order to make it easier to insert the felts. Removable intermediate pieces which are fastened to the lower frame part by means of screws are provided at the disconnecting point between the two frame parts. In the event of a high contact force, the reaction forces which act on the upper frame part lift the said frame part off from the intermediate pieces by a small amount. In order that the two frame parts are reliably connected to one another even in the loaded state of the wet press, the following is provided. A plurality of pulling elements in the form of lugs are connected to the lower frame part with the aid of joints. Each of the lugs has a slot at its other end. In each case one plug-in pin which at the same time rests in a hole of the upper frame part can be inserted through the slots of a plurality of lugs which lie in one row. The lugs limit the amount by which the upper frame part is lifted off from the intermediate pieces in the loaded state. At the same time, they transmit the reaction forces which result from the contact force from the upper frame part to the lower frame part. A disadvantage here is that the connection only limits and does not prevent the lifting of the upper frame part.

It is therefore an object of the present invention to provide an apparatus for forming an extended nip between a mating roll and a shoe roll for treating a product web, which apparatus permits simple connection of the bearing housings of the rolls.

This object is achieved in accordance with claim 1.

As a result of this, an apparatus for forming an extended nip between a mating roll and a shoe roll for treating a product web is provided, which apparatus permits locking of brackets. Connecting lugs are arranged displaceably in a groove of a bracket. A connection between the brackets is produced by means of fastening elements, the lugs having force action faces which are in contact with the said fastening elements in a locking position. In order to release the connection, in each case only the fastening elements of a bracket need be pulled out and the connecting lugs retracted. Here, the fastening elements of the respective other bracket can form a stop for this retracting movement.

Further refinements of the invention can be gathered from the following description and the subclaims.

In the following text, the invention will be explained in greater detail using the exemplary embodiment which is shown in the appended drawings, in which.

Figure 1:
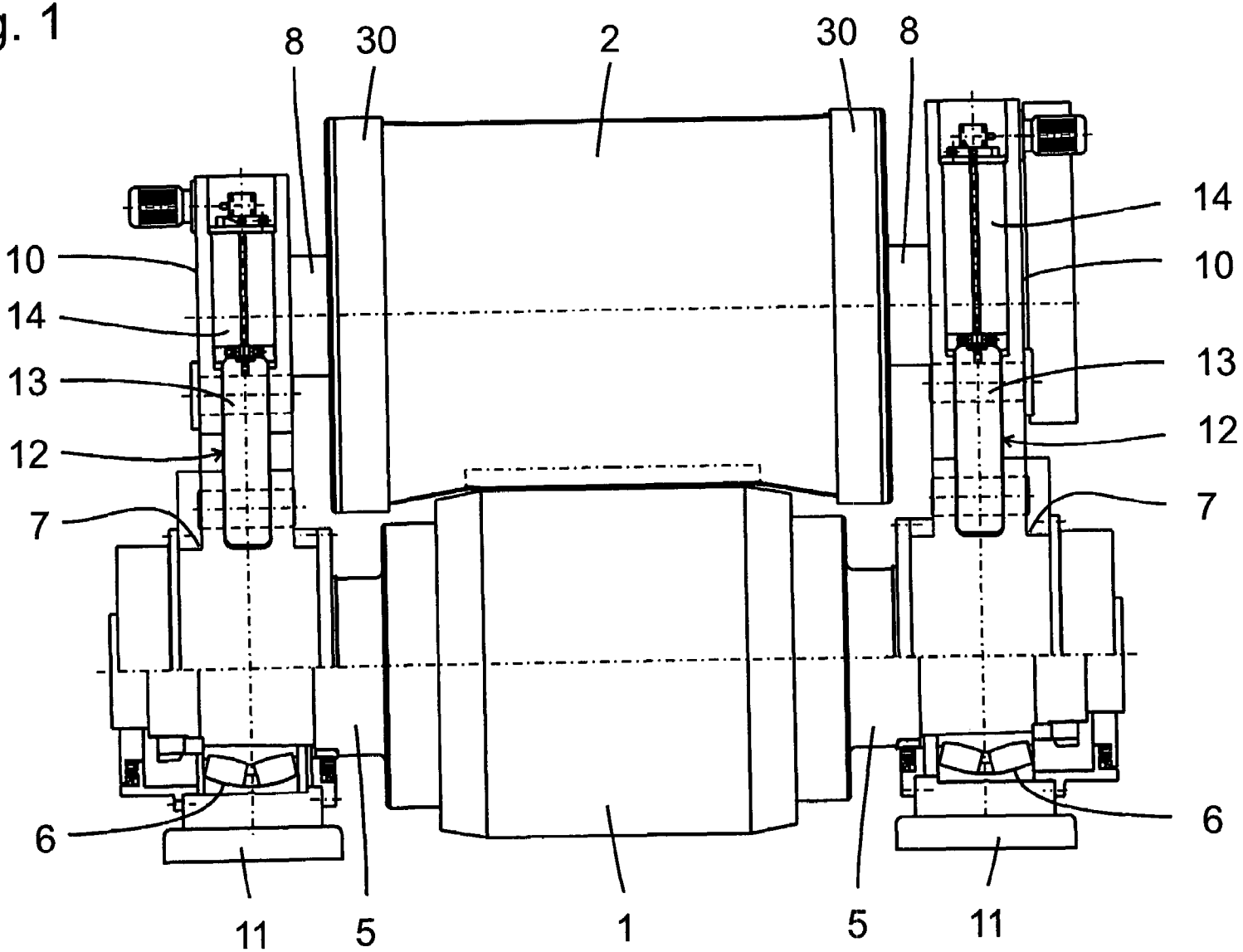
FIG. 1 shows a side view, in partial section, of an apparatus for forming an extended nip between a mating roll and a shoe roll for treating a product web.

The invention relates to an apparatus for forming an extended nip between a mating roll 1 and a shoe roll 2 for treating a product web, in particular a paper web. The mating roll 1 and the shoe roll 2 have roll axes 3 and 4 which lie in a loading plane E.

The mating roll 1 has a rotatable roll shell with bearing journals 5 fastened to the ends thereof, each bearing journal 5 being supported in a first bracket 7 via a roll-end assembly 6 of a bearing. The shoe roll 2 has a tube-shaped, flexible press shell which is fastened to two rotatable shell carrying discs 30. Each shell carrying disc 30 rests on a stationary bearing journal 8. Each bearing journal 8 is supported via a bearing 9 in a second bracket 10. One of the brackets 7, 10 is fastened to a stand 11. Which of the brackets 7, 10 is fastened to the stand 11 depends on which of the rolls 1, 2 which are arranged above one another is arranged at the bottom. Both rolls 1, 2 are suitable for this purpose. According to the exemplary embodiment shown, the mating roll 1 is arranged at the bottom and, accordingly, the first bracket 7 is fastened to the stand 11.

The brackets 7, 10 can be connected by means of releasable devices 12. The releasable devices 12 comprise connecting lugs 13 which are guided displaceably, in particularly vertically, in grooves 14 of one of the brackets 10 between a locked position and at least one unlocked position along connecting axes V. The grooves 14 are preferably provided on the bracket 10 of the shoe roll 2 having the stationary roll journals 8.

Each connecting lug 13 has a slot 15 which extends parallel to a connecting axis V. Fastening pins 16, 17 which can be inserted in the locked position into one and the other bracket 7, 10 can be inserted through the slot 15 of a connecting lug 13 and can be brought into engagement with opposite force action faces 18, 19 of the respective slot 15.

The fastening pins 16, 17 can preferably be inserted into the respective bracket 7, 10 parallel to the loading plane E. For this purpose, the brackets 7, 10 preferably have plug-in holes 20. The length of the slots 15 of the connecting lugs 13 is adapted to the spacing of the inserted fastening pins 16, 17 when the brackets are standing on one another, in order for it to be possible to lock the latter without a spacing.

Figure 2A:
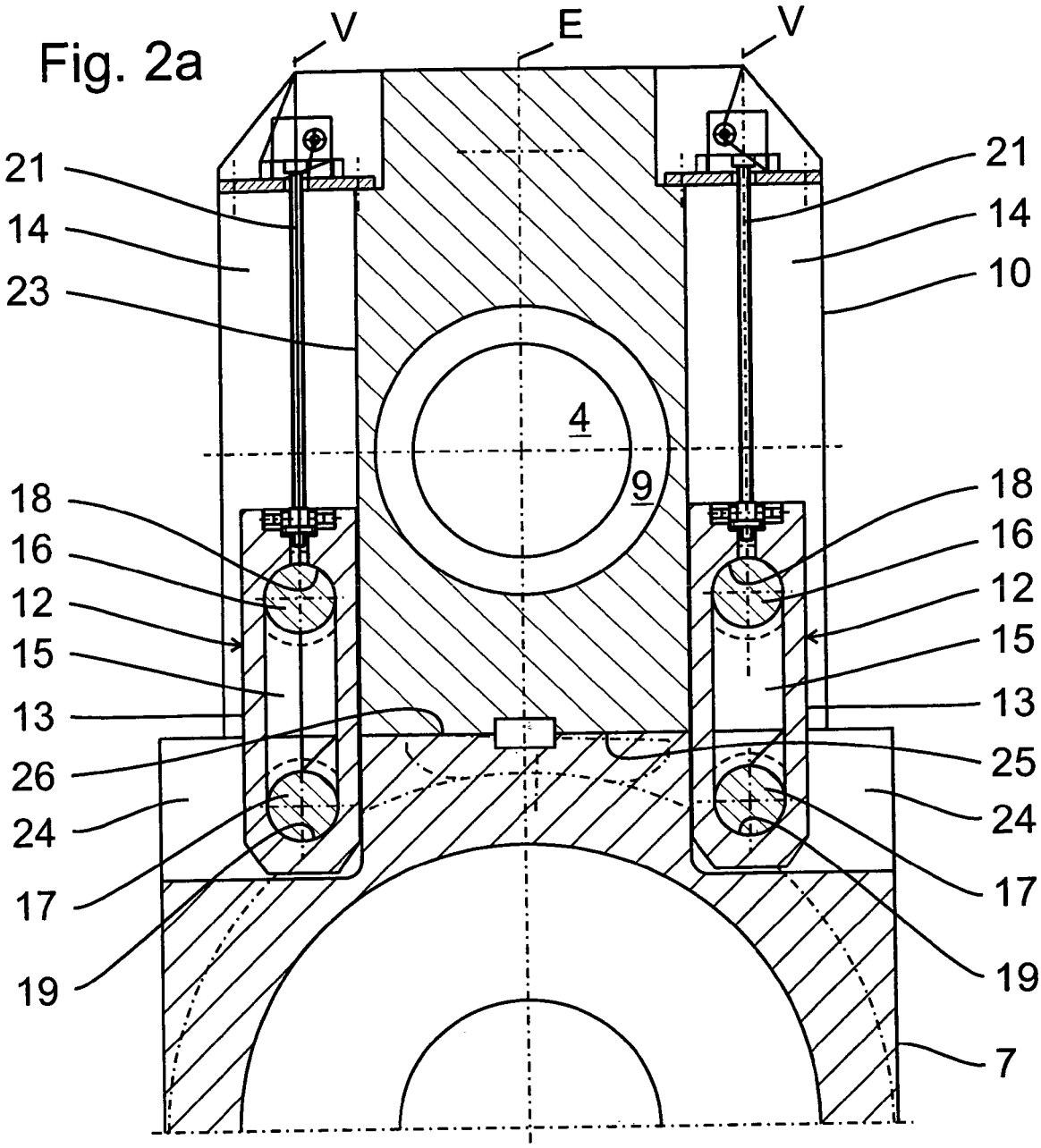
FIGS. 2A and 2B show partial cross sections according to A-A in FIG. 1 in a locked position and an unlocked position.

In the locked position, as shown in FIG. 2A, the fastening pins 16, 17 of one and the other bracket 7, 10 come into contact with force action faces 18, 19 which are formed by inner limbs of the connecting lugs 13.

Figure 2B:
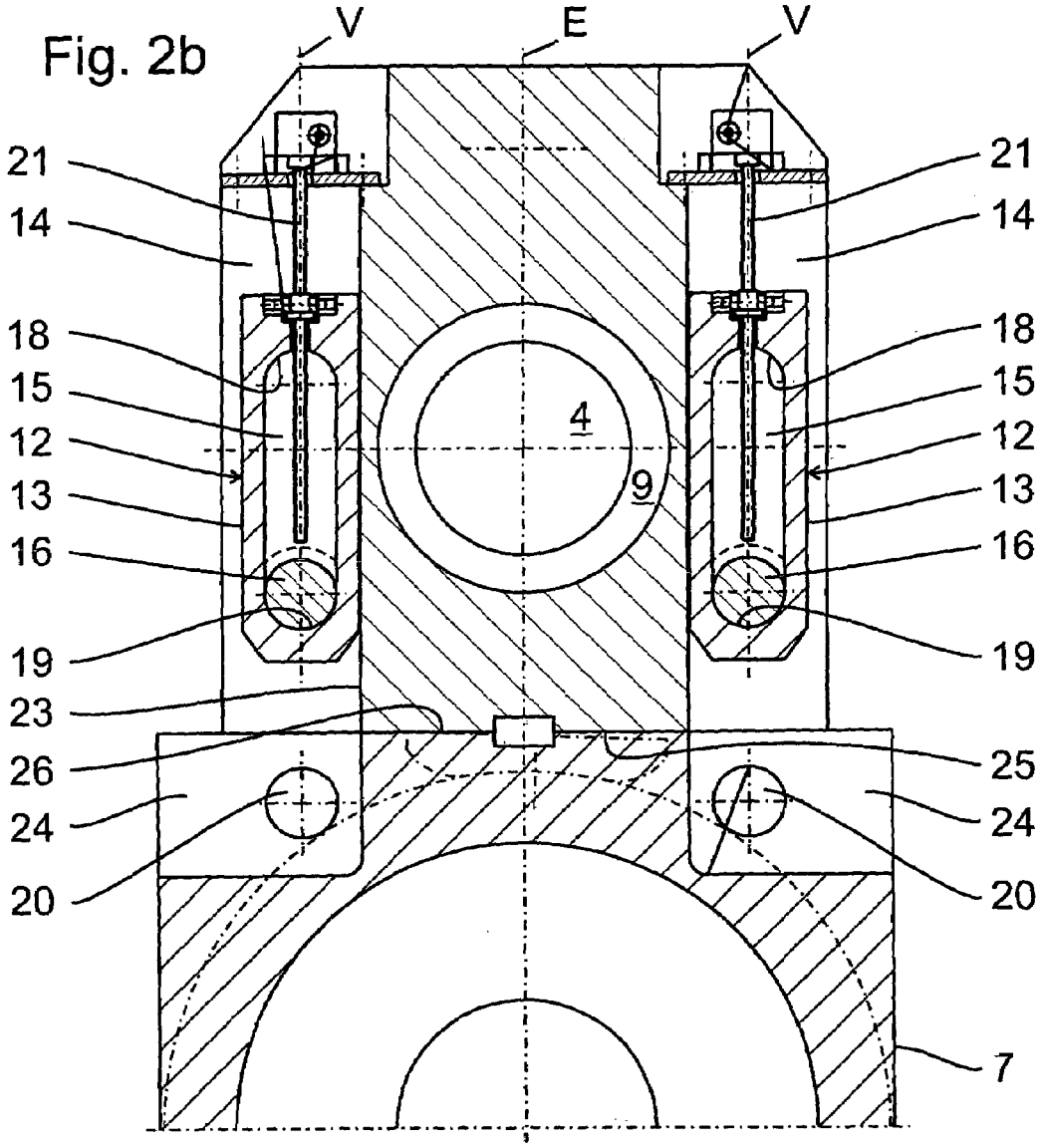
Figure 3:
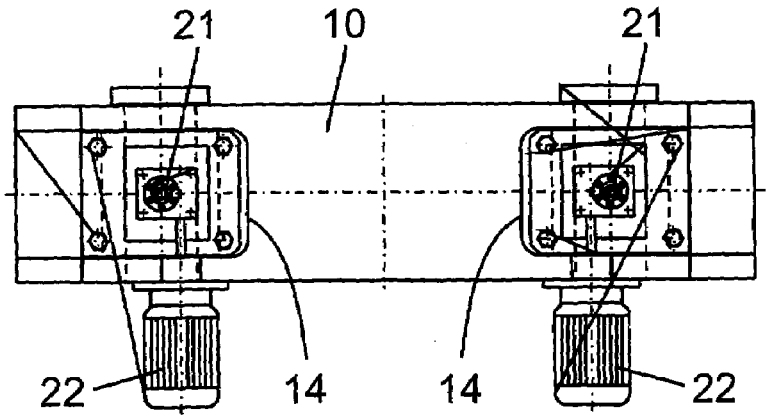
FIG. 3 shows a plan view of a bracket.

In the at least one unlocked position, as shown in FIG. 2B, the connecting lugs 13 come into contact with the fastening pins 16 which can be inserted in the bracket 10 which is provided with grooves 14.

The connecting lugs 13 are guided so as to be displaceable in each case on a spindle 21 which can be rotated by means of motors 22. In order to release the locking of the brackets 7, 10, only the one fastening pin 17 need be removed and the connecting lugs 13 pulled up or moved out of an engagement position with the other bracket 7.

The brackets 7, 10 can preferably be locked at both roll ends by a pair of connecting lugs 13 which each have two fastening pins 16, 17, the connecting lugs 13 being arranged so as to be displaceable in grooves 14 symmetrically with respect to the loading plane E.

At least one groove face 23 of the grooves 14 preferably forms in each case one sliding guide for the connecting lug 13 which is guided in this groove 14. The grooves 14 can be configured to be open on one side.

The grooves 14 of one bracket 10 are aligned in each case with recesses 24 of the other bracket 7. The connecting lugs 13 are displaced into these recesses by means of the spindles 21 with a front lug end, in order to engage behind the fastening pins 17 which can be inserted in the locked position. Here, the brackets 7, 10 can be connected in a manner sitting directly on one another. For this purpose, the brackets 7, 10 have abutting faces 25, 26.

Furthermore, the brackets 7, 10 are preferably fixed in position with respect to one another in the running direction of the machine by feather keys or pins.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

The invention claimed is:

1. Apparatus for forming an extended nip between a mating roll and a shoe roll for treating a product web, in particular a paper web, the roll axes of which lie in a loading plane E, having a mating roll which is supported via in each case one roll-end assembly on in each case one bearing in a first bracket, having a shoe roll which has stationary bearing journals which are supported in each case via a bearing in each case one second bracket, one of the brackets being fastened to a stand, and having releasable devices for connecting the brackets to one another, wherein the releasable connecting elements comprise connecting lugs which are guided displaceably in grooves of one of the brackets between a locked position and at least one unlocked position along connecting axes, each connecting lug having a slot which extends parallel to a connecting axis and through which fastening pins which can be inserted in the locked position into one and the other bracket can be inserted and can be brought into engagement with opposite force action faces of the respective slot; and wherein the fastening pins can be inserted into the respective bracket symmetrically with respect to the loading plane.

2. Apparatus for forming an extended nip according to claim 1, wherein, in the locked position, the fastening pins of one and the other bracket come into contact with force action faces which are formed by inner limbs of the connecting lugs.

3. Apparatus according to claim 1, wherein, in the at least one unlocked position, the connecting lugs can come into contact with the fastening pins which can be inserted in the bracket which is provided with grooves.

4. Apparatus according to claim 1, wherein the connecting lugs are guided so as to be displaceable in each case on a spindle.

5. Apparatus according to claim 1, wherein the brackets can be locked by a pair of connecting lugs which each have two fastening pins, the connecting lugs being arranged symmetrically with respect to the loading plane.

6. Apparatus according to claim 1, wherein at least in each case one groove face of the grooves forms a sliding guide for a connecting lug.

7. Apparatus according to claim 1, wherein the grooves can be configured to be open on one side.

8. Apparatus according to claim 1, wherein the grooves of one bracket are aligned with recesses of the other bracket, into which connecting lugs with a front lug end for engaging behind the fastening bolts which can be inserted can be displaced in the locked position.

9. Apparatus according to claim 1, wherein the brackets can be connected in a manner sitting on one another.

10. Apparatus according to claim 9, wherein the brackets can be connected via abutting faces.

11. Apparatus according to claim 1, wherein the brackets can be positioned with respect to one another in the running direction of the machine by feather keys or pins.

12. Apparatus according to claim 1, wherein the connecting lugs can be displaced in grooves which are configured in the second bracket.

13. Apparatus for forming an extended nip between a mating roll and a shoe roll for treating a product web, in particular a paper web, the roll axes of which lie in a loading plane E, having a mating roll which is supported via in each case one roll-end assembly on in each case one bearing in a first bracket, having a shoe roll which has stationary bearing journals which are supported in each case via a bearing in each case one second bracket, one of the brackets being fastened to a stand, and having releasable devices for connecting the brackets to one another, wherein the releasable connecting elements comprise connecting lugs which are guided displaceably in grooves of one of the brackets between a locked position and at least one unlocked position along connecting axes, each connecting lug having a slot which extends parallel to a connecting axis and through which fastening pins which can be inserted in the locked position into one and the other bracket can be inserted and can be brought into engagement with opposite force action faces of the respective slot; and wherein, in the locked position, the fastening pins of one and the other bracket come into contact with force action faces which are formed by inner limbs of the connecting lugs.

14. Apparatus for forming an extended nip between a mating roll and a shoe roll for treating a product web, in particular a paper web, the roll axes of which lie in a loading plane E, having a mating roll which is supported via in each case one roll-end assembly on in each case one bearing in a first bracket, having a shoe roll which has stationary bearing journals which are supported in each case via a bearing in each case one second bracket, one of the brackets being fastened to a stand, and having releasable devices for connecting the brackets to one another, wherein the releasable connecting elements comprise connecting lugs which are guided displaceably in grooves of one of the brackets between a locked position and at least one unlocked position along connecting axes, each connecting lug having a slot which extends parallel to a connecting axis and through which fastening pins which can be inserted in the locked position into one and the other bracket can be inserted and can be brought into engagement with opposite force action faces of the respective slot; and wherein, in the at least one unlocked position, the connecting lugs can come into contact with the fastening pins which can be inserted in the bracket which is provided with grooves.

15. Apparatus for forming an extended nip between a mating roll and a shoe roll for treating a product web, in particular a paper web, the roll axes of which lie in a loading plane E, having a mating roll which is supported via in each case one roll-end assembly on in each case one bearing in a first bracket, having a shoe roll which has stationary bearing journals which are supported in each case via a bearing in each case one second bracket, one of the brackets being fastened to a stand, and having releasable devices for connecting the brackets to one another, wherein the releasable connecting elements comprise connecting lugs which are guided displaceably in grooves of one of the brackets between a locked position and at least one unlocked position along connecting axes, each connecting lug having a slot which extends parallel to a connecting axis and through which fastening pins which can be inserted in the locked position into one and the other bracket can be inserted and can be brought into engagement with opposite force action faces of the respective slot; and wherein the connecting lugs are guided so as to be displaceable in each case on a spindle.

16. Apparatus for forming an extended nip between a mating roll and a shoe roll for treating a product web, in particular a paper web, the roll axes of which lie in a loading plane E, having a mating roll which is supported via in each case one roll-end assembly on in each case one bearing in a first bracket, having a shoe roll which has stationary bearing journals which are supported in each case via a bearing in each case one second bracket, one of the brackets being fastened to a stand, and having releasable devices for connecting the brackets to one another, wherein the releasable connecting elements comprise connecting lugs which are guided displaceably in grooves of one of the brackets between a locked position and at least one unlocked position along connecting axes, each connecting lug having a slot which extends parallel to a connecting axis and through which fastening pins which can be inserted in the locked position into one and the other bracket can be inserted and can be brought into engagement with opposite force action faces of the respective slot; and wherein the brackets can be locked by a pair of connecting lugs which each have two fastening pins, the connecting lugs being arranged symmetrically with respect to the loading plane.

17. Apparatus for forming an extended nip between a mating roll and a shoe roll for treating a product web, in particular a paper web, the roll axes of which lie in a loading plane E, having a mating roll which is supported via in each case one roll-end assembly on in each case one bearing in a first bracket, having a shoe roll which has stationary bearing journals which are supported in each case via a bearing in each case one second bracket, one of the brackets being fastened to a stand, and having releasable devices for connecting the brackets to one another, wherein the releasable connecting elements comprise connecting lugs which are guided displaceably in grooves of one of the brackets between a locked position and at least one unlocked position along connecting axes, each connecting lug having a slot which extends parallel to a connecting axis and through which fastening pins which can be inserted in the locked position into one and the other bracket can be inserted and can be brought into engagement with opposite force action faces of the respective slot; and wherein at least in each case one groove face of the grooves forms a sliding guide for a connecting lug.

18. Apparatus for forming an extended nip between a mating roll and a shoe roll for treating a product web, in particular a paper web, the roll axes of which lie in a loading plane E, having a mating roll which is supported via in each case one roll-end assembly on in each case one bearing in a first bracket, having a shoe roll which has stationary bearing journals which are supported in each case via a bearing in each case one second bracket, one of the brackets being fastened to a stand, and having releasable devices for connecting the brackets to one another, wherein the releasable connecting elements comprise connecting lugs which are guided displaceably in grooves of one of the brackets between a locked position and at least one unlocked position along connecting axes, each connecting lug having a slot which extends parallel to a connecting axis and through which fastening pins which can be inserted in the locked position into one and the other bracket can be inserted and can be brought into engagement with opposite force action faces of the respective slot; and wherein the grooves can be configured to be open on one side.

19. Apparatus for forming an extended nip between a mating roll and a shoe roll for treating a product web, in particular a paper web, the roll axes of which lie in a loading plane E, having a mating roll which is supported via in each case one roll-end assembly on in each case one bearing in a first bracket, having a shoe roll which has stationary bearing journals which are supported in each case via a bearing in each case one second bracket, one of the brackets being fastened to a stand, and having releasable devices for connecting the brackets to one another, wherein the releasable connecting elements comprise connecting lugs which are guided displaceably in grooves of one of the brackets between a locked position and at least one unlocked position along connecting axes, each connecting lug having a slot which extends parallel to a connecting axis and through which fastening pins which can be inserted in the locked position into one and the other bracket can be inserted and can be brought into engagement with opposite force action faces of the respective slot; and wherein the grooves of one bracket are aligned with recesses of the other bracket, into which connecting lugs with a front lug end for engaging behind the fastening pins which can be inserted can be displaced in the locked position.

20. Apparatus for forming an extended nip between a mating roll and a shoe roll for treating a product web, in particular a paper web, the roll axes of which lie in a loading plane E, having a mating roll which is supported via in each case one roll-end assembly on in each case one bearing in a first bracket, having a shoe roll which has stationary bearing journals which are supported in each case via a bearing in each case one second bracket, one of the brackets being fastened to a stand, and having releasable devices for connecting the brackets to one another, wherein the releasable connecting elements comprise connecting lugs which are guided displaceably in grooves of one of the brackets between a locked position and at least one unlocked position along connecting axes, each connecting lug having a slot which extends parallel to a connecting axis and through which fastening pins which can be inserted in the locked position into one and the other bracket can be inserted and can be brought into engagement with opposite force action faces of the respective slot; and wherein the brackets can be positioned with respect to one another in the running direction of the machine by feather keys or pins.

21. Apparatus for forming an extended nip between a mating roll and a shoe roll for treating a product web, in particular a paper web, the roll axes of which lie in a loading plane E, having a mating roll which is supported via in each case one roll-end assembly on in each case one bearing in a first bracket, having a shoe roll which has stationary bearing journals which are supported in each case via a bearing in each case one second bracket, one of the brackets being fastened to a stand, and having releasable devices for connecting the brackets to one another, wherein the releasable connecting elements comprise connecting lugs which are guided displaceably in grooves of one of the brackets between a locked position and at least one unlocked position along connecting axes, each connecting lug having a slot which extends parallel to a connecting axis and through which fastening pins which can be inserted in the locked position into one and the other bracket can be inserted and can be brought into engagement with opposite force action faces of the respective slot; and wherein the connecting lugs can be displaced in grooves which are configured in the second bracket.

* * * * *